United States Patent [19]

Nuckolls et al.

[11] Patent Number: 4,890,041

[45] Date of Patent: Dec. 26, 1989

[54] HIGH WATTAGE HID LAMP CIRCUIT

[75] Inventors: Joe A. Nuckolls, Blacksburg, Va.; Paul E. Payne, Vero Beach, Fla.

[73] Assignee: Hubbell Incorporated, Orange, Conn.

[21] Appl. No.: 166,494

[22] Filed: Mar. 10, 1988

[51] Int. Cl.[4] ..... H05B 37/00; H05B 39/00

[52] U.S. Cl. ..... 315/225; 315/171; 315/172; 315/176; 315/177; 315/244; 315/DIG. 5

[58] Field of Search ..... 315/171, 172, 173, 174, 315/175, 176, 177, 225, 276, 287, 289, DIG. 7, 244, 245, DIG. 5, DIG. 2

[56] References Cited

U.S. PATENT DOCUMENTS

| | | | |
|---|---|---|---|
| 4,127,795 | 11/1978 | Knoll | 315/DIG. 5 |
| 4,342,948 | 8/1982 | Samuels | 315/DIG. 2 |
| 4,663,571 | 5/1987 | Nilssen | 315/DIG. 5 |
| 4,682,082 | 7/1987 | MacAskill et al. | 315/DIG. 5 |

FOREIGN PATENT DOCUMENTS

| | | |
|---|---|---|
| 0124735 | 3/1984 | European Pat. Off. . |
| 2185867 | 7/1987 | United Kingdom . |

*Primary Examiner*—Donald J. Yusko
*Assistant Examiner*—Brian Palladino
*Attorney, Agent, or Firm*—Jerry M. Presson; Walter C. Farley

[57] ABSTRACT

A lamp start, hot-restart and operating circuit for a high wattage, high intensity discharge lamp includes cascaded resonant circuits with capacitors and series-connected inductors connected to an AC source. A pulse circuit including two pulse transformers supplies streamer-forming current, the secondary windings of the pulse transformers being connected in series with the lamp. When the lamp commences normal operation, the operating current energizes a relay to remove the capacitors and pulse circuit from the operating circuit, allowing the inductor to function as the lamp ballast.

13 Claims, 2 Drawing Sheets

HIGH WATTAGE HID LAMP CIRCUIT

This invention relates to an improved circuit for use with a high wattage high intensity discharge (HID) lamp for starting the lamp, providing proper power to operate the lamp within the desired operating range, and instantly restarting the hot, deionized lamp if the lamp should be extinguished by a temporary power interruption or the like.

BACKGROUND OF THE INVENTION

The problems of starting and hot restarting a high intensity discharge lamp are well known and numerous circuits have been developed in efforts to solve the problems associated with such lamps. Most such circuits have been developed for the purpose of operating lamps of relatively low wattage, i.e., having rated powers ranging from less than 100 to a few hundred watts. Circuits developed for this purpose have not been suitable for use with high wattage HID lamps, particularly metal halide lamps. It has been found that such lamps require higher reionization voltage and energy, more intermediate or "carry through" voltage and energy than such circuits have been able to deliver, plus increased open circuit voltage to initiate and stabilize the arc.

SUMMARY OF THE INVENTION

Accordingly, an object of the invention is to provide a circuit for starting, hot-restarting and operating a high wattage high intensity discharge lamp, the term "high wattage" being used to refer to lamps having power ratings of about 1000 watts or above.

A further object is to provide such a circuit which will automatically deactivate itself after a predetermined interval if it is connected to a failed lamp.

Another object is to provide such a circuit in which the starting elements are deactivated in response to the flow of normal operating lamp current.

Yet another object is to provide such a circuit which is reliable and can be constructed at reasonable cost.

Briefly described, the invention includes a lamp start, hot restart and operating circuit for a high wattage, high intensity discharge lamp, including a source of AC power and first and second cascaded resonant circuits connected between the source and the lamp for forming an arc-forming discharge current for the lamp, each of the resonant circuits including a series-connected inductive reactor. Pulse circuit means is coupled to the resonant circuits and to the lamp for producing a streamer-forming pulse discharge current for the lamp, the pulse circuit means including first and second pulse transformers having their secondary windings connected in series-aiding relationship and connected in series with the lamp, and a deactivating circuit responsive to lamp operating current for deactivating the pulse circuit and the resonant circuits so that the reactors function as a ballast for the lamp during normal operation.

Although the circuits of the present invention were initially developed for high wattage lamps, it has subsequently been found, somewhat surprisingly, that the same techniques employed therein can be used with lower voltage inputs to operate lamps rated at lower power levels. Thus, the circuits are quite flexible and can readily be adapted to operate lamps in the range of about 250 watts to about 2000 watts.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification, and wherein.

DESCRIPTION OF PREFERRED EMBODIMENTS

Figure 1:
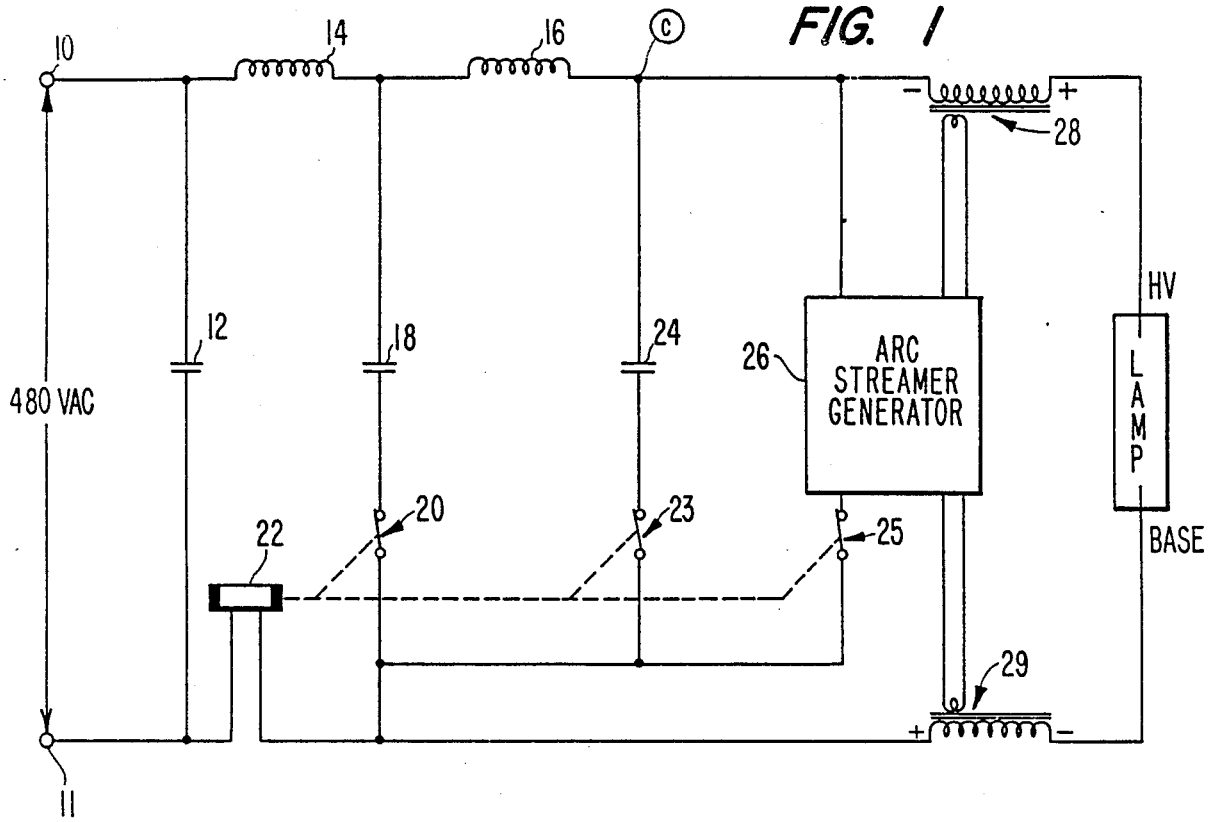
FIG. 1 is a schematic circuit diagram, partly in block form, of a start, hot restart and operating lamp circuit in accordance with the invention.

Referring first to FIG. 1, the circuit thereof includes a terminal 10 which is connected to a power line in the circuit and a terminal 11 which is connected to a common line. Terminals 10 and 11 are connectable to a 480-volt AC source. A capacitor 12 is connected directly across the terminals 10 and 11. First and second inductive reactors 14 and 16 are connected in series circuit relationship with each other in the power line. Each of these reactors is designed, for a 1500-watt HID lamp, to have a reactance of about 84.9 mH at the line frequency and, preferably, the reactors are substantially identical to each other. A capacitor 18, also having a value of about 20 microfarads, is connected from the power line between reactors 14 and 16 to the common line through a normally closed contact set indicated generally at 20 which is actuated by energization of the winding of an electromagnetic relay 22 connected in series in the common line. Relay 22 is a current responsive relay designed to be energized when normal lamp operating current flows therethrough.

At the other side of reactor 16, a capacitor 24 having a value of about 5 microfarads is connected between the power line and common line through a normally closed contact set 23 of relay 22. Also at the same side of reactor 16, an arc streamer generator circuit 26 is connected between the power line and the common line through a contact set 25 of relay 22. Circuit 26 includes a high-voltage pulse circuit for initiating an arc streamer through a lamp. The output of circuit 26 is delivered to the primary windings of two step-up pulse transformers 28 and 29, the secondary windings of which are connected in series with each other and with high intensity discharge lamp 30. The secondary windings of the pulse transformers are connected with the lamp in between them and are phased so that they are aiding as indicated by the polarization markings on the drawing.

Capacitor 12 serves as a power factor correcting capacitor during normal operation and "stiffens" the AC source during hot restarting. Accordingly, this capacitor remains in the circuit at all times.

The values of capacitors 18 and 24 are selected to resonate with reactors 14 and 16 at selected frequencies to produce specific current patterns in the circuit during the start and hot-restart modes of operation. However, when the lamp has gone into full ignition and operating current flows through relay 22, contact sets 20 and 23 are opened, removing capacitors 18 and 24 from operation and leaving reactors 14 and 16 to function as the reactor ballast during normal lamp operation. For a 1500-watt lamp, capacitor 18 is selected to resonate with reactor 14 at approximately the second harmonic of the line voltage frequency. Similarly, capacitor 24 resonates with reactor 16 at approximately the fourth harmonic. When line voltage is applied, the open circuit voltage between point C at the output side of reactor 16 and the common line is approximately 700 volts RMS as compared with the 480 volts applied to terminals 10 and 11.

This high, sine wave open-circuit voltage supplies arc streamer generator circuit 26 which supplies relatively high frequency pulse energy through both pulse transformers 28 and 29 to the lamp. These high voltage pulses cause the formation of a streamer within the lamp and, once the streamer has been formed, the intermediate frequency voltage from capacitor 24 provides sufficient energy to cause an arc discharge to form within the lamp, removing the streamer from the lamp wall. This function is primarily performed by the fourth harmonic energy. Finally, once the discharge has been formed, a higher energy level at lower voltage, at the second harmonic, produces a high current discharge through the lamp which is then maintained by the 60 Hz power supplied directly from the line. In the last portion of this operation, operating current is sensed by relay 22, opening contact sets 20 and 23 and also a normally closed contact set 25 which is the common connection for arc streamer generator 26, removing capacitors 18 and 24 and leaving the line current at 60 Hz to maintain the arc.

Circuit 26 also includes a time delay circuit which permits pulses to be applied for a predetermined interval, such as five seconds, but if the lamp does not reach full ignition by the end of that interval, the high voltage pulse circuit is deactivated and is latched out of operation until the line voltage is removed and restored. If the high voltage pulses from circuit 26, in conjunction with the other currents discussed, do not force the lamp into operation, there is a very strong probability that the lamp itself has failed or reached the end of its useful life, or that there is a major problem with the lamp wiring. Accordingly, the pulses are terminated to avoid damage to the circuitry or to the lamp mechanical components.

The series aiding connection of the secondary windings of pulse transformers 28 and 29 allows doubling the high voltage and its energy level applied to the lamp without increasing the high voltage to the fixture and avoiding the electrical stress applied to those components.

Figure 2:
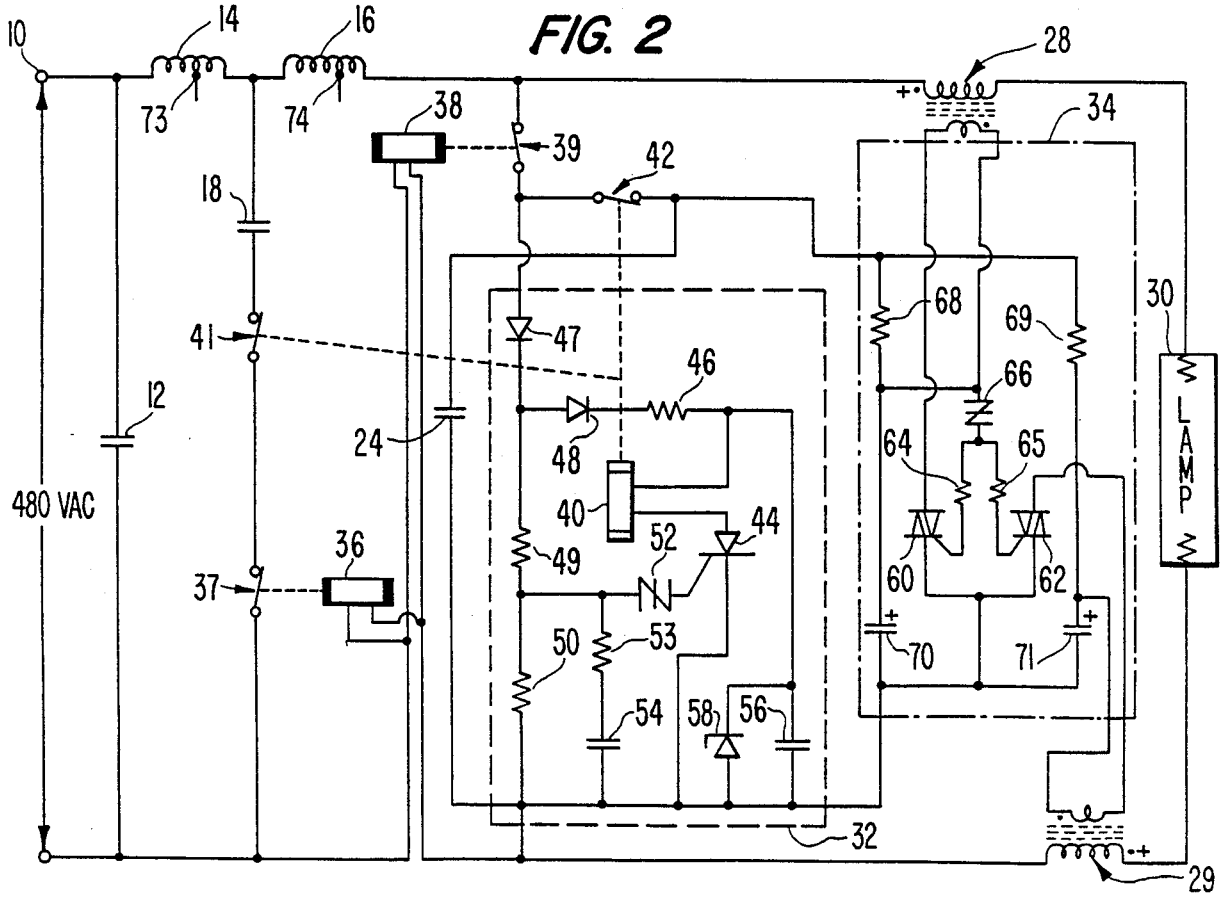
FIG. 2 is a more detailed schematic circuit diagram of a further embodiment of a lamp circuit.

FIG. 2 shows in somewhat greater detail a circuit which operates on the principles of FIG. 1. It will be recognized that reactors 14 and 16, capacitors 12, 18 and 24, pulse transformers 28 and 29, and lamp 30 remain in the same relative relationships and their functions are substantially unchanged. However, arc streamer generator circuit 26 is now shown as consisting of an on-time determining circuit 32 and a pulse generating circuit 34. It will also be observed that the arrangement of relays is somewhat different, a relay 36 having a contact set 37 arranged to respond to operating current and to open the circuit leading to capacitor 18 only. A separate relay 38, connected in parallel with relay 36 to also respond to operating current, has a contact set 39 in the conductor which supplies not only capacitor 24 but also timing circuit 32 and pulse circuit 34. Still further, a relay 40 having normally closed contact sets 41 and 42 responds to the conclusion of the timing function in circuit 32 to remove capacitor 18, capacitor 24 and pulse circuit 34 from the system at the conclusion of the timing interval.

Circuit 32 includes a controlled rectifier (SCR) 44, the switchable conductive path of which is connected in series with the winding of relay 40 and also in series with a resistor 46 and diodes 47 and 48 between the power and common lines. Diode 47 is also connected to a voltage divider circuit including resistors 49 and 50, the junction between these resistors being connected to a breakdown diode 52, which leads to the gate of SCR 44, and an RC circuit including resistor 53 and capacitor 54.

A capacitor 56 is connected in parallel with the circuit including the winding of relay 40 and SCR 44. The voltage across capacitor 56 is limited by a parallel-connected zener diode 58. As will be recognized by those skilled in the art, SCR 44 is rendered conductive when the voltage across capacitor 54 reaches a sufficiently high voltage to cause breakdown of diode 52 and, when SCR 44 conducts, relay 40 is energized, opening contact sets 41 and 42. Opening contact set 42 removes pulse circuit 34 from operation and opening contact set 41 removes capacitor 18 from the circuit. The charging current which develops the voltage on capacitor 54 flows through diode 47, resistor 49 and resistor 53, the divider effect of resistors 49 and 50 determining the level of the charging current. Since diode 47 is connected to the fourth harmonic supply at the output of reactor 16, many half-cycles of current are used to charge the capacitor. The charging is relatively slow, depending upon the values chosen for the components, but it is intentionally made slow so that the pulse circuit has an adequate opportunity to cause ignition of lamp 30.

Before SCR 44 is made conductive, capacitor 56 is charged through diodes 47 and 48 and through a limiting resistor 46, the voltage on capacitor 56 being limited by diode 58. Capacitor 56 acts as a filter capacitor and diode 48 prevents discharging of capacitor 56 into the timing circuit including capacitor 54.

After SCR 44 has become conductive, energizing current for relay 40 is supplied by the half-wave direct current supply through diode 47 and is maintained in the energized state by the charge developed on capacitor 56. Thus, the SCR is maintained in the conductive state and relay 40 is kept energized. Energization of relay 40 removes the starting and restarting components from the system, allowing the apparatus to electrically behave like a normal ballast having a failed lamp. As previously indicated, relay 40 should not operate until the pulses from circuit 34 have had an opportunity to put lamp 30 into operation and have not done so.

Circuit 34 includes two high frequency triacs 60 and 62, triac 60 having a conductive path which extends between the common line and the primary winding of pulse transformer 28. Similarly, triac 62 has a switchable conductive path between the primary winding of pulse transformer 29 and the common line. The gate electrodes of the triacs are connected through resistors 64 and 65, respectively, and a breakdown diode 66. Charging circuits for the gates include resistors 68 and 69 which are connected, respectively, to capacitors 70 and 71, the junction between resistor 68 and capacitor 70 being connected to diode 66. The supply, as previously indicated, comes through contact set 42.

When the voltage across capacitor 70 reaches approximately 480 volts, the breakdown diode becomes conductive and triggers the gates of both triacs together, rendering them simultaneously conductive. The energy stored in capacitors 70 and 71 is then delivered through the energized triacs to the primary windings of the pulse transformers which are connected in a series aiding relationship, as shown, to cause ignition voltage doubling and in-time phasing. Each pulse transformer has a primary-to-secondary ratio of approximately 8 turns to 200 turns. Resistors 68 and 69 determine the charging rate of the capacitors 70 and 71 and also isolate the discharge of these capacitors, in a high frequency sense, as they discharge through the pulse transformer primaries. Resistors 64 and 65 serve to limit the peak gating of the triacs and the peak sidac current, thereby protecting these devices.

As indicated in connection with FIG. 1, the pulse transformers produce a high voltage output in the secondaries which is applied to the lamp to cause a streamer which is then backed by high voltage ionization current delivered from reactors 14 and 16 and their associated capacitors until, finally, with the lamp in full operation, the capacitors are removed from the circuit and maintenance current is supplied by the 480-volt AC line supply. Again, if the pulses fail to ignite the lamp, circuit 32 removes the pulse circuit by opening contact set 42. Lamp operation energizes relays 36 and 38 to remove all of the starting circuit components from operation.

It will also be observed that reactors 14 and 16 are provided with taps 73 and 74, respectively, which are not connected to anything in the circuit of FIG. 2. These taps are provided so that, for a 1000-watt lamp, a lower voltage and reactance can be employed. By providing a tap in this fashion, identical reactors can be used for either a 1000- or 1500-watt lamp with the other circuit component remaining the same. Using two 400-watt 240-volt high pressure sodium reactors provides the correct lamp operating wattage for a 1000-watt device properly tapped.

Figure 3:
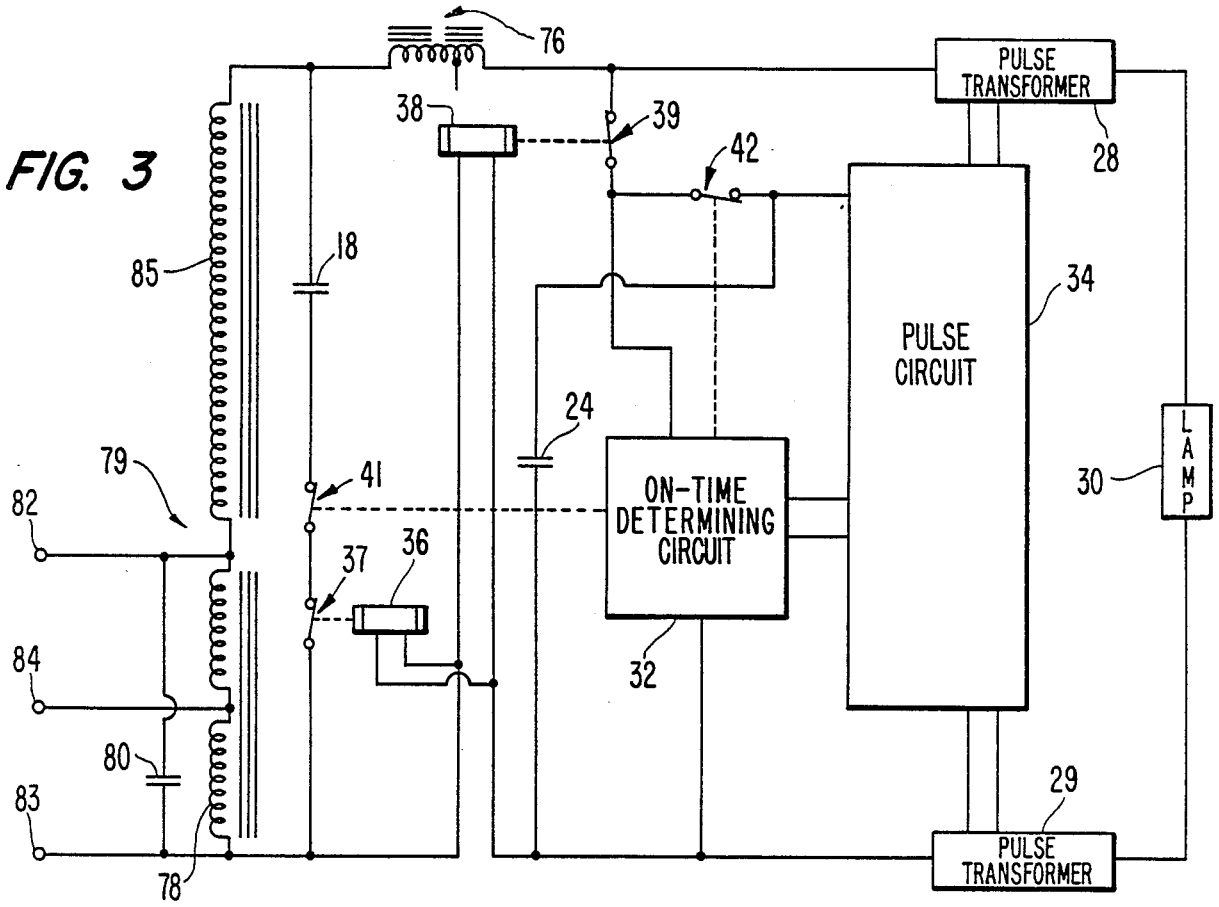
FIG. 3 is a schematic circuit diagram, partly in block form, showing a similar circuit used with a high reactance transformer or lag ballast.

FIG. 3 shows a circuit which is fundamentally similar to FIG. 2 except that a single reactor 76 is in series with the pulse transformers and lamp, and the supply is provided through a lag ballast or high impedance transformer indicated generally at 79 which allows the use of a lower source voltage. The transformer 79 includes a primary winding 78 having a capacitor 80 connected in parallel therewith, the primary winding having a center tap so that different voltages can be applied thereto. End terminals 82 and 83 can be connected to a 240-volt supply or, alternatively, terminals 83 and 84 can be connected to a 120-volt supply. The secondary winding 85 also functions as the first reactor equivalent in operation to reactor 14. Capacitor 80 performs the power factor correction and energy storage function of capacitor 12 in the circuits of FIGS. 1 and 2. Capacitor 18 is connected across the entire reactance transformer through contact sets 41 and 37, as before.

Except for the transformer itself, which is a well-understood element in this context, the remainder of the circuit performs as previously described in connection with FIG. 2. Accordingly, that description will not be repeated.

Figure 4:
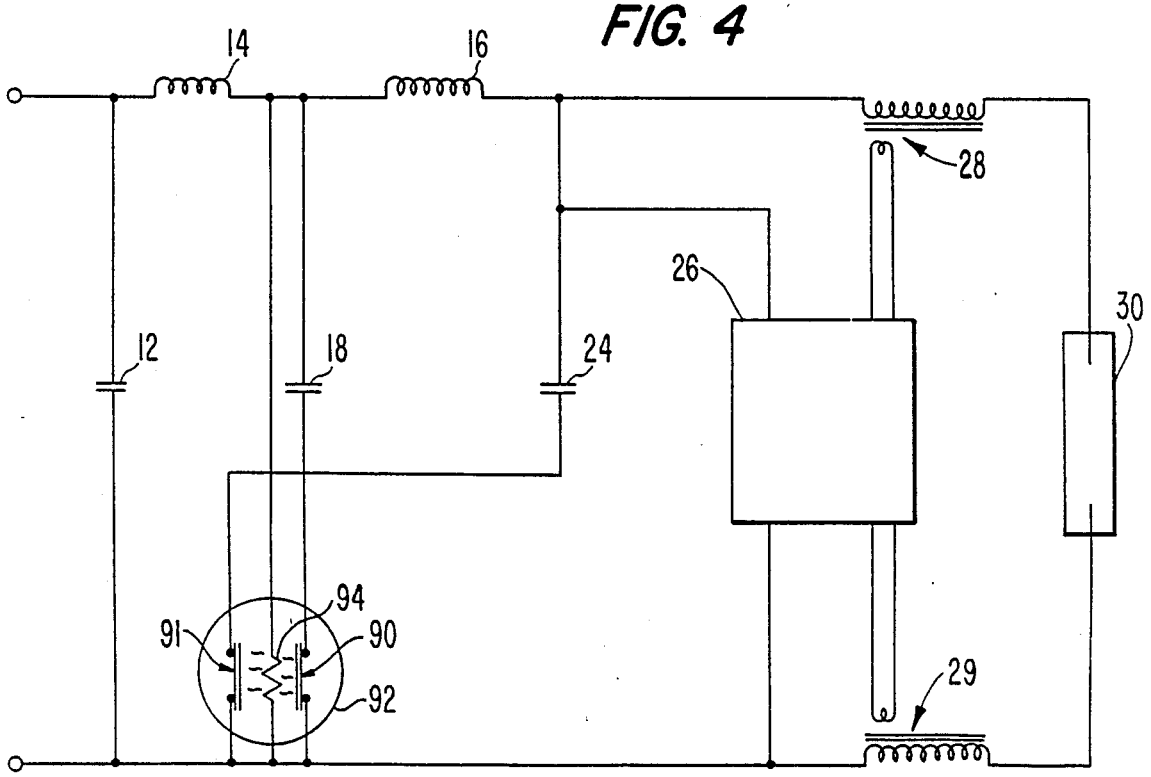
FIG. 4 is a schematic circuit diagram, partly in block form, of a circuit similar to FIG. 1 employing a different form of deactivation means.

FIG. 4 shows a circuit which is substantially identical to FIG. 1 insofar as the start and hot restart circuit arrangement and operation is concerned. However, FIG. 4 introduces a different technique for deactivating the circuit in the event that lamp ignition is not achieved within a predetermined, relatively short time. The circuit components which are the same as described in connection with FIG. 1 are identified by the same reference numerals and will not be described again. It will be observed that relay 22 is eliminated as are contact sets 20, 23 and 25. Instead, the pulse circuit 26 is connected to the common line and capacitors 18 and 24 are connected to the common line, respectively, through thermally activated normally closed contact sets indicated generally at 90 and 91 within a thermal switch unit 92. A positive temperature coefficient resistance heater 94 is contained within device 92 so that it is in good heat conducting relationship with contact sets 90 and 91. Each of contact sets 90 and 91 can be a bimetallic device of a type which distorts upon reaching a predetermined temperature, thereby opening the contact set.

In operation, when the circuit is energized and the lamp has not yet ignited, a relatively high open-circuit voltage exists between the output side of reactor 14 and the common line. This high open circuit voltage causes current flow through resistor 94 which generates heat to elevate the temperature of contact sets 90 and 91. The current flowing at the high, open circuit voltage moves the resistance value of the PTC element 94 to a point on its operating curve at which the current level is high, generating sufficient heat to activate the contact sets and open the circuits within a matter of a few seconds. However, if the lamp becomes fully ignited and operating current begins to flow, the voltage decreases with a concomitant decreasing level of current, allowing the device to remain dormant.

It will be observed that the present invention involves the use of multiple inductances in conjuction with multiple capacitances to form cascaded harmonic or tuned circuits to raise the available line voltage to a much higher voltage and to raise the capacitance energy level so that it is available to establish or reestablish a high intensity thermal arc in a hot deionized lamp. The voltages generated by these cascaded circuits are in parallel with the lamp. Thus, the level of the instantaneous lamp power consumption, which represents the loading on the resonant circuits, serves to ensure adequate capacitive voltage and energy oscillation to meet the lamp's needs in hot restarting. Further, the use of the same basic inductances forms a controlled, sequential lamp electrical stimulation which forces the lamp into rapid hot restart without damaging the lamp electrodes and employs the inductances for stable normal operation. The use of two substantially identical high voltage generator circuits connected, including the pulse transformers, in a series aiding fashion and synchronized to double the peak high voltage and energy is provided in a way which allows smaller part sizes and easier packaging. Finally, the current responsive technique for deactivating the starting components when lamp operation has commenced relies upon lamp RMS current and causes the circuit to revert to a lag ballast only when the lamp is completely restruck.

While certain advantageous embodiments have been chosen to illustrate the invention, it will be understood by those skilled in the art that various changes and modifications can be made therein without departing from the scope of the invention as defined in the appended claims.

What is claimed is:

1. A lamp start, hot restart and operating circuit comprising the combination of a socket for receiving a high intensity discharge lamp;
a source of AC power;
first and second cascaded resonant circuits connected between said source and said lamp for forming an arc-forming discharge current for said lamp, each of said resonant circuits including a series-connected inductive reactor;
pulse circuit means coupled to said resonant circuits and to said lamp for producing a streamer-forming pulse discharge current for said lamp, said pulse circuit means including first and second pulse transformers having their secondary windings connected in series-aiding relationship and connected in series with said lamp; and
deactivating circuit means responsive to lamp operating current for deactivating said pulse circuit means and said resonant circuits so that said reactors function as a ballast for said lamp during normal operation.

2. A circuit according to claim 1 and further including means for deactivating said pulse circuit means in the absence of lamp operating current after a predetermined interval of pulse discharge current.

3. A start, hot restart and operating circuit for a high wattage, high intensity discharge lamp comprising the combination of
a source of AC voltage having a power line and a common line;
a first capacitor connected across said source between said power and common lines;
first and second inductive reactors connected in series circuit relationship with each other and said power line;
a second capacitor connected between said first reactor and said common line, said second capacitor having a value selected to resonate with said first reactor at a first frequency;
a third capacitor connected between said second reactor and said common line, said third capacitor having a value selected to resonate with said second reactor at a second frequency;
a high wattage, high intensity discharge lamp;
first and second pulse transformers each having a primary winding and a secondary winding;
circuit means interconnecting said lamp with said secondary windings of said pulse transformers with said lamp between said secondary windings; and
pulse circuit means connected to said second reactor and to said primary windings to provide pulse energy across said lamp to start or restart said lamp, said windings being connected so that the pulse produced thereby are in an aiding phase relationship.

4. A circuit according to claim 3 wherein said first frequency is substantially equal to an even harmonic of said source.

5. A circuit according to claim 4 wherein said first frequency is substantially equal to the second harmonic of said source.

6. A circuit according to claim 5 wherein said second frequency is substantially equal to an even harmonic of said source higher than said second harmonic.

7. A circuit according to claim 4 wherein said second frequency is substantially equal to an even harmonic of said source higher than said first frequency.

8. A circuit according to claim 3 and further comprising circuit means responsive to lamp operating current for deactivating said pulse circuit means and said second and third capacitors.

9. A method of starting, hot restarting and operating a high intensity discharge lamp comprising the steps of
connecting a plurality of series inductive elements and shunt capacitors to form a plurality of cascaded resonant circuits between a line source of AC power and a high intensity lamp for producing an arc-forming current build-up for the lamp,
tuning the cascaded resonant circuits to successively higher harmonics of the line source,
connecting a pulse circuit including first and second pulse transformers to the last of the resonant circuits for producing a streamer-forming current through the lamp,
energizing the resonant circuits and pulse circuit to form successive streamer and arc forming currents to ignite the lamp,
sensing lamp operating current, and
deactivating the pulse circuit and the resonant circuits in response to lamp operating current to allow the series inductive elements to function as a standard ballast for the lamp during normal lamp operation.

10. A method according to claim 9 and further including connecting the secondary windings of the pulse transformers in aiding relationship with each other and in series with the lamp.

11. A method according to claim 10 and further including deactivating the pulse circuit in the absence of lamp operating current after a predetermined interval of streamer-forming current.

12. A method according to claim 11 wherein the resonant circuits are deactivated by disconnecting the shunt capacitors.

13. A method according to claim 9 which includes tuning the resonant circuits to even harmonics of the line source.

* * * * *